US005938427A

United States Patent [19]

Suzuki et al.

[11] Patent Number: 5,938,427

[45] Date of Patent: Aug. 17, 1999

[54] COMBUSTION APPARATUS

[75] Inventors: Jiro Suzuki, Nara; Masato Hosaka, Osaka; Akira Maenishi, Ikeda; Yutaka Yoshida, Nabari, all of Japan

[73] Assignee: Matsushita Electric Industrial, Co. Ltd., Osaka, Japan

[21] Appl. No.: 08/569,835

[22] Filed: Dec. 6, 1995

[30] Foreign Application Priority Data

| | | | |
|---|---|---|---|
| Dec. 6, 1994 | [JP] | Japan | 6-302472 |
| Dec. 6, 1994 | [JP] | Japan | 6-302473 |
| May 16, 1995 | [JP] | Japan | 7-117537 |

[51] Int. Cl.[6] ..... F23D 11/44; F23Q 11/00

[52] U.S. Cl. ..... 431/208; 431/11; 431/268; 431/7; 431/170

[58] Field of Search ..... 431/208, 7, 11, 431/41, 268, 170, 326, 328; 122/4 D

[56] References Cited

U.S. PATENT DOCUMENTS

| | | | |
|---|---|---|---|
| 3,199,505 | 8/1965 | LLoyd | 431/208 |
| 4,445,570 | 5/1984 | Retallick . | |

FOREIGN PATENT DOCUMENTS

| | | | |
|---|---|---|---|
| 0 570 933 | 11/1993 | European Pat. Off. . | |
| 2811273 | 7/1979 | Germany | 431/208 |
| 37 16 187 | 11/1987 | Germany . | |
| 39 01 061 | 7/1990 | Germany . | |
| 4204320 | 8/1993 | Germany . | |
| 43 06 722 | 3/1994 | Germany . | |
| 43 17 544 | 12/1994 | Germany . | |
| 57-101209 | 6/1982 | Japan . | |
| 0140511 | 8/1983 | Japan | 431/268 |
| 0036813 | 2/1985 | Japan | 431/268 |
| 0060041 | 4/1985 | Japan | 431/268 |
| 63-156919 | 9/1985 | Japan . | |
| 60-235904 | 11/1985 | Japan . | |
| 58-178108 | 10/1989 | Japan . | |
| 4-288402 | 10/1992 | Japan . | |
| 7-110114 | 4/1995 | Japan . | |

OTHER PUBLICATIONS

European Search Report dated Jul. 29, 1997.

European Search Report dated Apr. 29, 1997.

*Primary Examiner*—Carl D. Price

*Attorney, Agent, or Firm*—Ratner & Prestia

[57] ABSTRACT

According to a combustion apparatus comprising a mixing unit 3 for preparing a fuel-air mixture by mixing a fuel with combustion air, a first catalytic combustion chamber 4 incorporating a first catalyzer 7 for catalytically burning the mixture and a fin 5 for collecting a thermal energy generated by the catalytic combustion and a second catalytic combustion chamber 12 incorporating a second catalyzer 14 for catalytically burning the mixture that is not catalytically burnt by the first catalyzer 7, an operation of catalytic combustion at a high load can be achieved. An operation for improving characteristics of an exhaust discharged at the time of ignition can be also obtained, as a result, a combustion apparatus reduced in emission of NOx is provided.

24 Claims, 10 Drawing Sheets

COMBUSTION APPARATUS

BACKGROUND OF THE INVENTION

1. Field of the Invention

The present invention relates to a combustion apparatus for use in a heating system, hot water supply system, air-conditioning system, portable heater and other equipment in which such gaseous fuel as natural gas and propane gas or liquid fuel such as kerosene and light oil are burnt for providing a heat source.

2. Related Art of the Invention

Catalytic combustion is a method of burning a fuel-air mixture by using a catalyzer with a platinum alloy carried by such ceramic carrier as honeycomb and fiber.

A catalyst used for combustion has a selective adsorption to oxygen and hydrocarbon, and allows them to react with each other on a surface of the catalyst. In such operation, because the catalyst is at a temperature lower than that obtained by flame combustion of an identical gas, almost no NOx is produced. It is a problem, however, that the temperature of a catalyzer is increased to 1,200° C. or a higher temperature, if a combustion apparatus using a catalyst is operated at a combustion load (intensity of combustion in relation to a volume of combustion chamber) identical to that of a flame combustion apparatus, and a life of the catalyst in terms of heat resistance is significantly reduced. It is, therefore, required to use the catalyst at a temperature lower than a critical temperature of heat resistance thereof by using means for reducing the combustion load and increasing the size of a combustion chamber or employing means for increasing the excess air ratio in a fuel-air mixture and reducing the combustion temperature.

Flame combustion is achieved at an excess air ratio of 1 to 2. On the other hand, catalytic combustion is achieved at an excess air ratio of 1 to 5, and it, therefore, allows use of a leaner fuel-air mixture. However, it is a problem that a thermal efficiency is considerably lowered, when a leaner fuel-air mixture is employed. It means that a difference in temperature between a heat exchanger and combustion exhaust is reduced, because a combustion temperature is lower at a lower concentration of fuel, and a rate of heat transfer is reduced. Thus, in order to obtain a higher heat efficiency, a heat exchanger of a larger size is required, and it has been difficult to provide a compact catalytic combustion apparatus having a high combustion capacity.

Additionally, in catalytic combustion, although it is required to preliminarily mix the air with a fuel to cause a reaction, it is a problem, when a liquid fuel is employed, that a higher heat is required for vaporizing the fuel. In a conventional liquid fuel combustion apparatus of vaporization type using the flame combustion method, although a vaporizing unit is heated by an electric heater only at an initial stage of the combustion, consumption of an electric power is low, because it is heated by applying a flame to a part of the vaporizing unit during stationary burning. In the case of a conventional combustion apparatus using the catalytic combustion method, however, it is a problem that an electric power supply is required for vaporization heat even in a stationary state, as no flame is formed, resulting in an additional power consumption.

SUMMARY OF THE INVENTION

In view of such problems associated with a conventional combustion apparatus, it is an object of the invention to provide a combustion apparatus minimizing production of NOx.

It is another object of the invention to provide a combustion apparatus using a catalyst and capable of eliminating the problem of significant reduction of a life of the catalyst in terms of heat resistance.

It is the other object of the invention to provide a combustion apparatus using a catalyst and allowing reduction in size thereof.

It is a further object of the invention to provide a combustion apparatus using a catalyst, not requiring heightening of excess air ratio for a fuel-air mixture and having a high combustion capacity in spite of a small size thereof.

It is an additional object of the invention to provide a combustion apparatus causing no unpleasant odor and the like, because no unburnt gas is released at an initial stage of the combustion.

It is still an object of the invention to provide a combustion apparatus not requiring electric power supply for vaporization heat even in a stationary state.

According to the invention, a combustion apparatus comprising a first catalytic combustion member in the form of a heat exchanger aligned in series with a second catalytic combustion member that has a large geometric surface area as represented by the form of a honeycomb construction is provided for solving the problems related to heat resisting properties of a catalyst and combustion load in the catalytic combustion. The first catalytic combustion member makes use of a high heat transfer property of catalytic combustion, and is formed as a heat exchanger with a catalyzer provided in heat receiving fins. Even if a large volume of high concentration mixture is burnt at the catalyzer, as heat produced by the combustion is exchanged, and removed, deterioration of the catalyzer due to a high temperature can be avoided. A part of fuel is burnt at the first catalytic combustion member, heat resulting from the combustion is removed therefrom, and the remaining fuel is burnt at a second catalyzer located downstream in the flowing direction. In order to raise the temperature of the second catalyzer above a temperature sufficient for causing a reaction of the catalyst, the fuel is shared between the first and second catalyzers for combustion without being burnt entirely at the first catalyzer.

Therefore, the first catalyzer is a catalyst carrier having a high thermal conductivity, and largely spaced from each other, while the second catalyzer is a catalyst carrier of a large geometric surface area, that is, finely spaced from each other.

Now, an operation of the first catalyzer achieved by making use of a high thermal conductivity of catalytic combustion according to the invention is described. In a conventional flame combustion apparatus, molecules of an exhaust at a high temperature cause oscillation of metal atoms of a heat exchanger, and conducts heat. Because molecules released from such oscillation are accumulated in a metal surface, and obstruct the heat to be transferred, a heat exchanging unit having a large surface area has been required. On the contrary, in the first catalyzer employed in a combustion apparatus of the invention, since a heat exchanging unit is directly covered by the catalyzer, a gaseous fuel adsorbs the catalyst, and generates heat, the heat directly causes thermal oscillation of atoms in a catalyst layer, and the oscillation is conducted to atoms of a metal forming the heat exchanger, resulting in heat transfer. Therefore, even in the case combustion taken place at a high intensity in a small area, because of a cooling effect due to the heat transfer, the catalyst is at a temperature of 900° C. or a lower. In addition, a combustion unit is integrated with a heat exchanging unit, which provides for reduction in size of the apparatus.

As a fuel is burned in part at the first catalyzer, no flame is formed downstream thereof. Then, catalytic combustion allowing a lean mixture to be burnt takes place at the second catalyzer. In order to burn the balance of gas unburnt entirely, it is suitable to provide a catalyzer of honeycomb construction having a large surface area. A reaction of the honeycomb catalyzer may be achieved according to a conventional technique.

As described herein, by using two catalyzers of distinct characteristics according to the invention, reduction of NOx characteristic of catalytic combustion at a low temperature, prevention of temperature rise of a catalyst due to a higher combustion load, a high efficiency of heat transfer achieved by catalytic combustion at the first catalyzer and reduction in size of a heat exchanger by integration can be simultaneously realized.

A practical consideration in such basic structure is how to start combustion. In order to start combustion, it is required to preliminarily increase the temperature of a catalyst above a temperature sufficient for activation. If preheating is insufficient, more unburnt gas is contained in an exhaust that is released during transition to catalytic combustion. It results in a waste of fuel, and also causes a problem of unpleasant combustion odor.

As means for increasing the temperature, an electric heater or a thermal energy of flame may be employed, and two types of catalytic combustion members must be heated simultaneously in synchronism by using such means. Because an entire volume of the fuel is not burnt at the first catalyzer, it is required that the second catalyzer always rises to a temperature sufficient for activation before start of the catalytic combustion so that no unburnt gas is discharged in an exhaust.

For such purpose, it is required to provide a flame combustion unit or electric heater between the first and second catalyzers for preheating the latter. It is because the second catalyzer cannot be heated by hot air, if preheating means is provided before the first catalyzer, since a heat exchanging unit is employed in the first catalyzer, and it is cooled thereby.

To intensify the combustion rapidly, it is also required to provide preheating means not only in the second catalyzer but also in the first catalyzer. If combustion is started before onset of reaction of the first catalyzer, a larger volume of fuel reacts at the second catalyzer until the first catalyzer reaches a stationary temperature, and reduction in quality of the second catalyzer is caused due to a high temperature. The time to reach stationary combustion, power consumption, initial characteristics of an exhaust, cost of a system and the like vary depending on a particular combination of such preheating means. By selecting suitable means for respective applications, a characteristic combustion can be started.

For reducing consumption of an electric power for vaporization when a liquid fuel is used, it is advantageous to provide a heat recovery unit carrying a catalyst that is integrated with the vaporizing unit upstream of the first catalyzer in the flowing direction.

BRIEF DESCRIPTION OF THE DRAWINGS

These and other objects, advantages, features, and uses will become more apparent as the description proceeds, when considered with the accompanying drawings in which:

FIG. 11(*b*) is a sectional view taken along a line Z–Z' of FIG. 11(*a*).

PREFERRED EMBODIMENTS OF THE INVENTION

Figure 1:
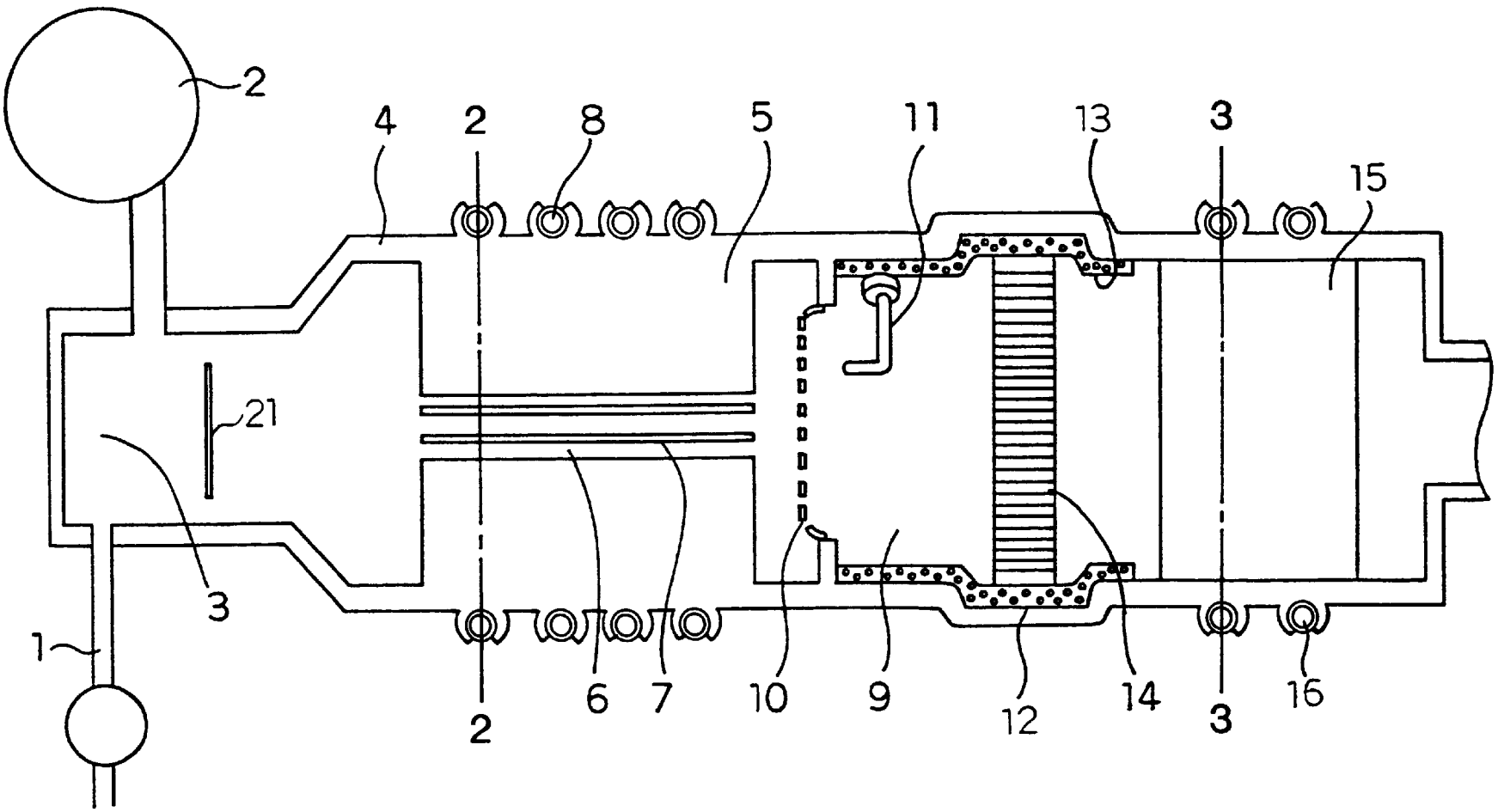
FIG. 1 is a sectional view of a combustion apparatus according to a first embodiment of the invention.

Referring now to FIG. 1, there is shown therein a sectional view of a combustion apparatus according to a first embodiment of the invention. Reference numeral 1 shows a fuel supply unit for feeding a gaseous fuel. Reference numeral 2 is a fan for supplying combustion air. Reference numeral 3 is a mixing unit for preparing a fuel-air mixture by mixing the gaseous fuel from the fuel supply unit 1 with combustion air from the fan 2. The mixing unit 3 contains a mixing plate 21 therein.

Figure 2:
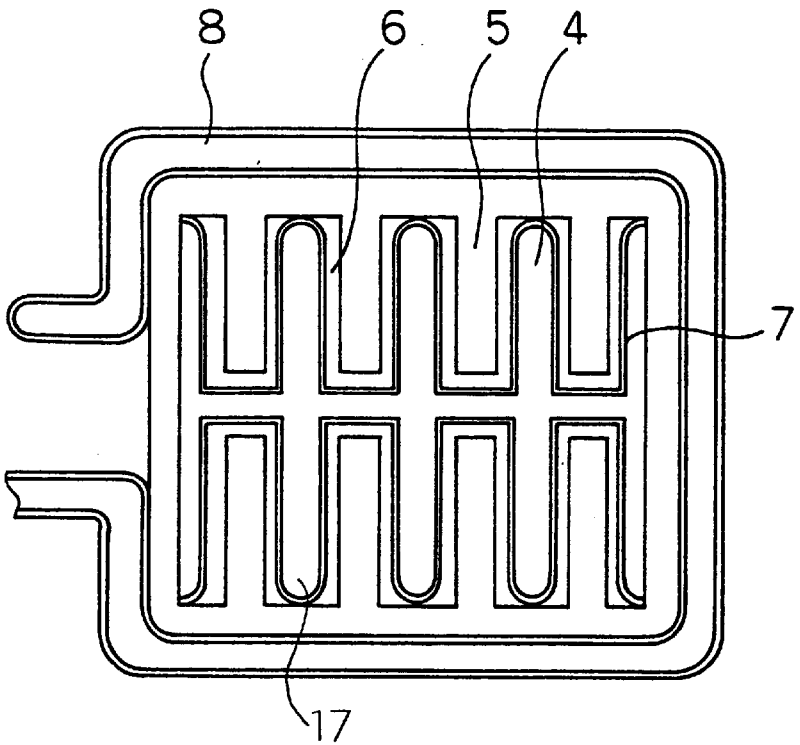
FIG. 2 is a sectional view taken along a line A–A' of FIG. 1.

Reference numeral 4 depicts a first catalytic combustion chamber provided in a downstream side of the mixing unit 3. Reference numeral 5 is a heat receiving fin projecting in an inner surface of the first catalytic combustion chamber 4. The fin 5 is 100 mm long in the flowing direction, 3 mm thick in every part thereof and 30 mm high. Reference numeral 7 is a first catalyzer in the shape of a thin plate formed in the fin 5 with a spacing 6 between them. The first catalyzer 7 comprises a base member made of a heat resistant iron alloy in the shape of a thin plate that is coated in both sides by a catalyst layer of an alumina carrying such platinum alloy catalyst as platinum and palladium. Reference numeral 8 is a first water channel provided for heat exchange in an outer circumference of the first catalytic combustion chamber 4 of an aluminum alloy. An interior of the first catalytic combustion chamber 4 and the first water channel 8 are also shown in FIG. 2, representing a sectional view along a line A–A' of FIG. 1.

Numeral 9 shows a flame combustion chamber in a downstream side of the first catalytic combustion chamber 4. Reference numeral 11 is such ignition means as a high-voltage discharger and high-temperature heater incorporated in the flame combustion chamber 9.

Reference numeral 10 is a flame stabilizing unit made of a wire gauze, punched metal or the like that is employed in an interface between the first catalytic combustion chamber 4 and flame combustion chamber 9.

Reference numeral 12 shows a second catalytic combustion chamber in a downstream side of the flame combustion chamber 9. Reference numeral 13 is a heat insulating member attached to an inner circumferential surface of the flame combustion chamber 9 and second catalytic combustion chamber 12. Reference numeral 14 depicts a second catalyzer of honeycomb construction containing 300 cells/$in^2$ that provides a geometric surface area larger than that of the first catalyzer 7. The second catalyzer 14 is 200 mm thick in the flowing direction. A honeycomb carrier of the second catalyzer 14 is of such porous ceramic material as cordierite and lime aluminate, and carries a platinum alloy catalyst. A bore of the honeycomb construction forms a square of 0.6 mm in side length.

Figure 3:
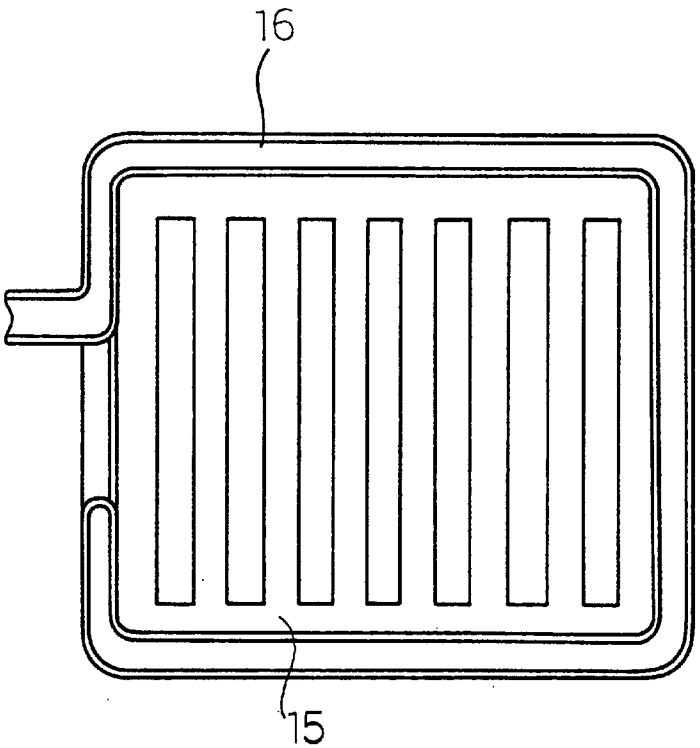
FIG. 3 is a sectional view taken along a line B–B' of FIG. 1.

Reference numeral 15 depicts a heat exchanging fin provided in a downstream side of the second catalytic combustion chamber 12 for collecting an exhaust heat. Reference numeral 16 is a second water channel employed for heat exchange in an outer circumferential surface of a chamber incorporating the fin 15. The second water channel 16 is connected with the first water channel 8. Water heated is used for air-conditioning and hot water supply systems. The fin 15 and second water channel 16 are also shown in FIG. 3, which is a sectional view taken along a line B–B' of FIG. 1.

The first and second water channels 8 and 16 may be replaced with an air cooling system. In such case, a warm air can be provided.

Now, the function of a combustion apparatus according to the invention is described.

A fuel-air mixture from the mixing unit 3 is passed through the first catalytic combustion chamber containing the fin 5 and first catalyzer 7. Although an excess air ratio of the mixture may be between 1 and 2 within an effective range of combustion, it should preferably fall between 1.1 and 1.6. It is because incomplete combustion may be caused due to local insufficiency of the air, if the excess air ratio is at 1.1 or less, and ignition may be difficult, if it is at 1.6 or more.

The mixture is flamed by ignition means 11 in the flame combustion chamber 9. Combustion is thereby started. The second catalyzer 14 is heated by the flame, and reaches a temperature of 300° C., which is sufficient for activation. A temperature sufficient for activation is different between types of fuels and catalysts, it is about 300° C. for propane gas, a higher temperature is required for methane, and a lower temperature for kerosine. As the flame combustion is continued in such condition, the second catalyzer 14 reaches a temperature of 400 to 600° C. When the first catalyzer 7 is heated to a temperature of 300° C. by heat radiation of an upstream surface of the second catalyzer 14 and flame stabilizing unit 10, a catalytic combustion reaction is started in a downstream side of the first catalyzer 7 in the flowing direction. As the first catalyzer 7 is increased in temperature by the reaction, the reacting point moves forwards the upstream direction along the first catalyzer 7.

When a volume of the mixture burnt in the first catalytic combustion chamber 4 is increased, 75% of a fuel supply is burnt in the first catalytic combustion chamber 4. The balance is burnt in the second catalytic combustion chamber 12. A fuel concentration of the mixture in the flame combustion chamber 9 is lowered as it is mixed with an exhaust, and the flame is extinguished. In the first catalyzer 7, a flameless combustion reaction is caused in a surface of the catalyst adsorbing the gaseous fuel and oxygen. Heat from the first catalyzer 7 is conducted through the spacing 6 to the fin 5 by means of heat radiation.

Although the first catalyzer 7 and the fin 5 may be partly in contact with each other, it is preferable to provide the spacing 6 between the first catalyzer 7 and the fin 5 entirely. Because the fin is at a temperature of 100 to 300° C. due to a cooling effect of the first water channel 8, if the first catalyzer 7 is in contact with the fin 5, as the catalyst is cooled, and its temperature is lowered almost to the temperature of fin 5, a temperature of the first catalyzer 7 falls below the temperature sufficient for activation.

Accordingly, by provision of the spacing 6 between the first catalyzer 7 and fin 5, since heat is conducted from the first catalyzer 7 to the fin 5 by means of heat radiation, when the first catalyzer 7 is at a higher temperature, the heat radiation is increased in proportion to the fourth power of the temperature, and an effect of prohibiting temperature rise of the first catalyzer 7 itself is obtained, resulting in saturation at or below a temperature with standable for the catalyzer. On the contrary, when the first catalyzer 7 is reduced in temperature, as the heat radiation is reduced in proportion to the fourth power of the temperature, an effect of prohibiting temperature fall of the first catalyzer 7 is obtained, resulting in stable combustion.

By referring to an experimental result, a combustion efficiency of the combustion apparatus is described below. The fuel-air mixture burnt in the first catalytic combustion chamber 4 was 75% of the fuel-air mixture sent from the mixing unit 3. Heat from the fuel-air mixture burnt in the first catalytic combustion chamber 4 is transferred by means of heat radiation from the fin 5 in the first catalytic combustion chamber 4 to the first water channel 8. An energy of the heat transferred from the fin 5 to the first water channel 8 was 80% of an energy generated by combustion in the first catalytic combustion chamber 4. It means that heat exchange achieved between the first catalytic combustion chamber 4 and the first water channel 8 was for 60% (=75×80%) of the fuel supplied to the combustion apparatus.

The balance of the mixture unburnt in the first catalytic combustion chamber 4 (hereinafter referred to as unburnt fuel) is contained in an exhaust discharged from the first catalytic combustion chamber 4. In other words, the unburnt fuel corresponds to 25% (=100%−75%) of the fuel supplied to the combustion apparatus.

On the other hand, if it is assumed that the balance, 15% (=75%−60%), of radiated heat which is not transferred from the fin 5 to the first water channel 8 is entirely discharged as an exhaust heat from the first catalytic combustion chamber 4 through the flame combustion chamber 9 to the second catalytic combustion chamber 12, an energy corresponding to 40% (=25%+15%) in total of the fuel supplied to the combustion apparatus is contained in an exhaust from the first catalytic combustion chamber 4.

Now, if the second catalyzer 14 is reduced in temperature, the heat exchange is taken place at a lower efficiency or totally eliminated, because reaction of an unburnt fuel is difficult. Therefore, in order to cope with the problem, a heat insulating member 13 is attached to an inner circumferential surface of the flame combustion chamber 9 and second catalytic combustion chamber 12. The second catalyzer 14 has a honeycomb construction providing a geometric surface area larger than that of the first catalyzer 7 for allowing more efficient catalytic combustion of the unburnt fuel. In such manner, the unburnt fuel is efficiently burnt in the second catalytic combustion chamber 12.

An exhaust heat discharged from the second catalytic combustion chamber 12 is transferred from the fin 15 to the second water channel 16. As a result of the experiment, it was found that an efficiency of exchange of the exhaust heat by the fin 15 was 70%. Then, if it is assumed that an entire volume of the unburnt fuel is combusted at the second catalyzer 14, an energy corresponding to 40% of the fuel supplied to the combustion apparatus is contained in the exhaust heat from the second catalytic combustion chamber 12. In such case, heat collected by the second water channel is 28% (=40%×70%).

Eventually, an overall thermal efficiency of the combustion apparatus evaluated from the experimental result is 88% (60%+28%), which is a sum of thermal energies collected by the first and second water channels 8 and 16. The ratio of combustion intensity between the first and second catalyzers is not limited to that of the embodiment, and an optimum value depends on a particular application and size of a device.

As shown in FIG. 2, the spacing 6 between the fin 5 and the first catalyzer 7 facing thereto may be smaller than the spacing 17 between adjacent first catalyzers 7. The first catalyzer 7 may be formed with a catalyst layer in the front and back sides thereof. By such arrangement, slipping of an unreacted fuel in the vicinity of the fin 5 can be prevented, and the combustion intensity associated with the first catalyzer 7 can be increased. Such effect is obtained because a temperature of the mixture in the vicinity of the fin 5 is lower than that of the mixture in the spacing 17, and progress of the catalytic reaction and scattering of the mixture over a surface of the catalyst are difficult.

Figure 4:
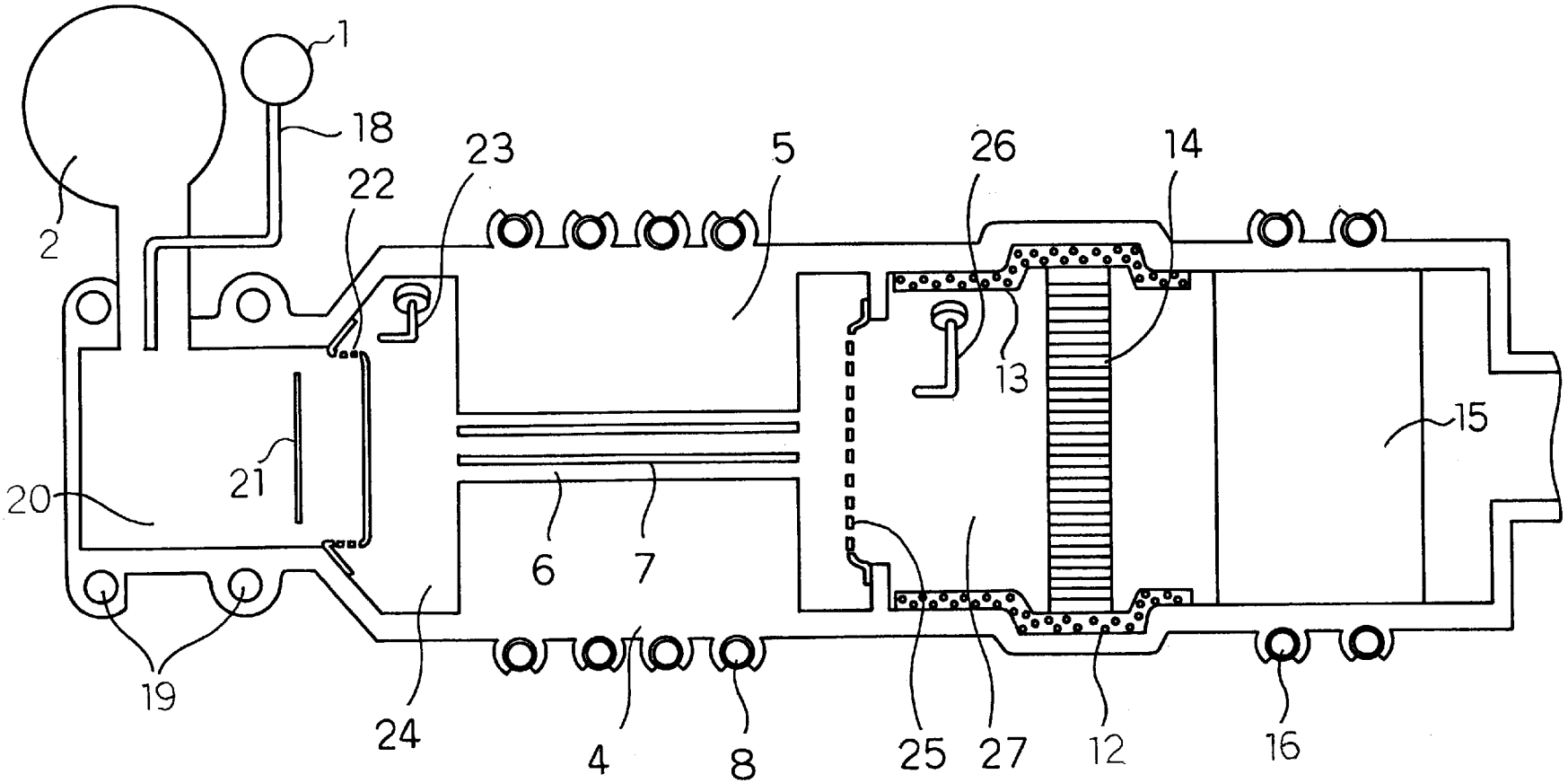
FIG. 4 is a sectional view of a combustion apparatus according to a second embodiment of the invention.

Referring to FIG. 4, there is shown therein a sectional view of a combustion apparatus according to a second embodiment of the invention. Reference numeral 1 is a fuel supply unit for feeding a liquid fuel through a fuel pipe 18. Reference numeral 19 is a vaporization heater for heating the liquid fuel. Reference numeral 2 depicts a fan for supplying combustion air. 20 is a vaporizing unit containing a mixing plate 21.

Reference numeral 24 shows a first flame combustion chamber provided in a downstream side of the vaporizing unit 20. Reference numeral 23 is first ignition means for igniting a fuel-air mixture prepared in the vaporizing unit 20. The first ignition means 23 is incorporated in the first flame combustion chamber 24. Reference numeral 22 depicts a first flame stabilizing unit positioned between the vaporizing unit 20 and the first flame combustion chamber 24.

Reference numeral 4 is a first catalytic combustion chamber employed in a downstream side of the first flame combustion chamber 24. Reference numeral 5 shows a heat receiving fin projecting in an inner surface of the first catalytic combustion chamber 4. Reference numeral 7 is a first catalyzer in the shape of a thin plate provided in the fin with a spacing 6 between them. Reference numeral 8 depicts a first water channel for heat collection located in an outer circumference of the first catalytic combustion chamber 4 of an aluminum alloy.

Reference numeral 27 shows a second flame combustion chamber positioned in a downstream side of the first catalytic combustion chamber 4. Reference numeral 26 is second ignition means for igniting the fuel-air mixture. The second ignition means 26 is incorporated in the second flame combustion chamber 27. Reference numeral 25 represents a second flame stabilizing unit situated between the first catalytic combustion chamber 4 and the second flame combustion chamber 27.

Reference numeral 12 is a second catalytic combustion chamber provided in a downstream side of the second flame combustion chamber 27. Reference numeral 14 shows a second catalyzer of honeycomb construction. The second catalyzer 14 is incorporated in the second catalytic combustion chamber 12. Reference numeral 13 is a heat insulating member attached to an inner circumferential surface of the flame combustion chamber 27 and the second catalytic combustion chamber 12.

Reference numeral 15 represents a heat exchanging fin disposed in a downstream side of the second catalytic combustion chamber 12 for collecting exhaust heat. Reference numeral 16 is a second water channel for heat exchange provided in an outer circumferential surface of a chamber incorporating the fin 15. The second water channel 16 is connected with the first water channel 8. Water heated is used for air-conditioning and hot water supply systems.

Thus, the embodiment is different from the first embodiment in that it further comprises the first flame combustion chamber 24 with the first ignition means incorporated therein and the first flame stabilizing unit 22, and is used with a liquid fuel.

Functions of the embodiment are described below.

A liquid fuel fed from the fuel supply unit 1 drips at a leading end of the fuel pipe 18 to the vaporizing unit 20. Since the leading end of fuel pipe 18 and the vaporizing unit 20 are heated by the vaporization heater 19, the liquid fuel is vaporized in the vaporizing unit 20. Then, the fuel vaporized is mixed by the mixing plate 21 in the vaporizing unit 20 with combustion air supplied by the fan 2, and a fuel-air mixture is prepared.

The mixture prepared at the vaporizing unit 20 is fed through the first flame combustion chamber 24 and first catalytic combustion chamber 4 to the second flame combustion chamber 27. The mixture sent to the second flame combustion chamber 27 is ignited by the second ignition means 26, and provides a flame.

The second catalyzer 14 is heated by the flame, and reaches a temperature of 300° C., which is sufficient for activation. Then, after the flame combustion is continued, and the second catalyzer 14 reaches a temperature of 400 to 600° C., the first ignition means 23 is energized, and allows the fuel-air mixture to be flamed in the first flame combustion chamber 24. The flame in the second flame combustion chamber 27 is then extinguished.

The first catalyzer 7 is increased in temperature from an upstream side in the flowing direction by a thermal energy of combustion taking place in the first flame combustion chamber 24. When the first catalyzer 7 reaches a temperature of 300 to 600° C. in an upstream side thereof, the fuel supply is discontinued for five seconds so that the flame in the first flame combustion chamber 24 is extinguished.

As the fuel supply is restarted after the flame is extinguished, catalytic combustion of the mixture fed from the vaporizing unit 20 is started upstream of the first and second catalyzers 7 and 14.

Because reduction in temperature of the second catalyzer 14 without a cooling arrangement in an outer circumferential part thereof is low, even at a low fuel concentration, it is kept at a high temperature, and the catalytic combustion is proceeded. Excessive reaction of the catalyst in the second catalyzer 14 is prevented, since the mixture is partly reacted at the first catalyzer 7. For such reason, a flow rate of the mixture sent from the vaporizing unit 20 can be increased. Consequently, more heat can be generated in an initial stage of combustion than that of the first embodiment.

The combustion is eventually stabilized, allowing 85% of the fuel supply to be burnt at the first catalyzer 7, and the balance at the second catalyzer 14. Such stationary state of combustion is similar to that of the first embodiment.

Now, functions of the combustion apparatus when a liquid fuel fed from the fuel supply unit 1 has a high boiling point such as kerosene or light oil are described. In such case, it is difficult to flame the fuel-air mixture fed to the second flame combustion chamber 27 by ignition of the second ignition means 26. Specifically, ignition at a low temperature is difficult. It is because the mixture is condensed, and the concentration is lowered, as it is passed through the first catalyzer 7.

In order to eliminate the problem, the combustion apparatus is operated in such manner as described below.

First, the mixture supplied from the vaporizing unit 20 to the first flame combustion chamber 24 is flamed. The first catalyzer 7 is heated by the flame. A temperature to be reached by such heating operation ranges from a dew point of the mixture to a temperature sufficient for activation of the catalyst. For example, in the case of kerosene, the temperature should be between 70 and 250° C. When the first catalyzer 7 reaches such temperature, the fuel supply is temporarily discontinued so that the flame in the first flame combustion chamber 24 is extinguished.

After the flame in the first flame combustion chamber 24 is extinguished, the fuel supply is restarted, and the mixture fed to the second flame combustion chamber 27 is ignited by the second ignition means 26. The mixture provides a flame, since it is not dewed in the first catalytic combustion chamber 4, hence no reduction in concentration. The second catalyzer 14 is heated by the flame, and reaches a temperature sufficient for activation.

When the temperature sufficient for activation of the second catalyzer 14 is reached, the first ignition means 23 is energized, and the mixture supplied to the first flame combustion chamber 24 is flamed. The flame in the second flame combustion chamber 27 is then extinguished. The first catalyzer 7 is increased in temperature from an upstream side by a thermal energy of combustion taking place in the first flame combustion chamber 24. When the first catalyzer 7 reaches a temperature of 400 to 600° C. in an upstream side thereof, the fuel supply is discontinued for five seconds so that the flame in the first flame combustion chamber 24 is extinguished.

As the fuel supply is restarted after the flame is extinguished, reaction of the mixture fed from the vaporizing unit 20 is initiated upstream of the first and second catalyzers 7 and 14, leading to stationary combustion.

By such operation, a liquid fuel having a high boiling point can be easily burnt. The stationary state of combustion is similar to that of the first embodiment.

Figure 5:
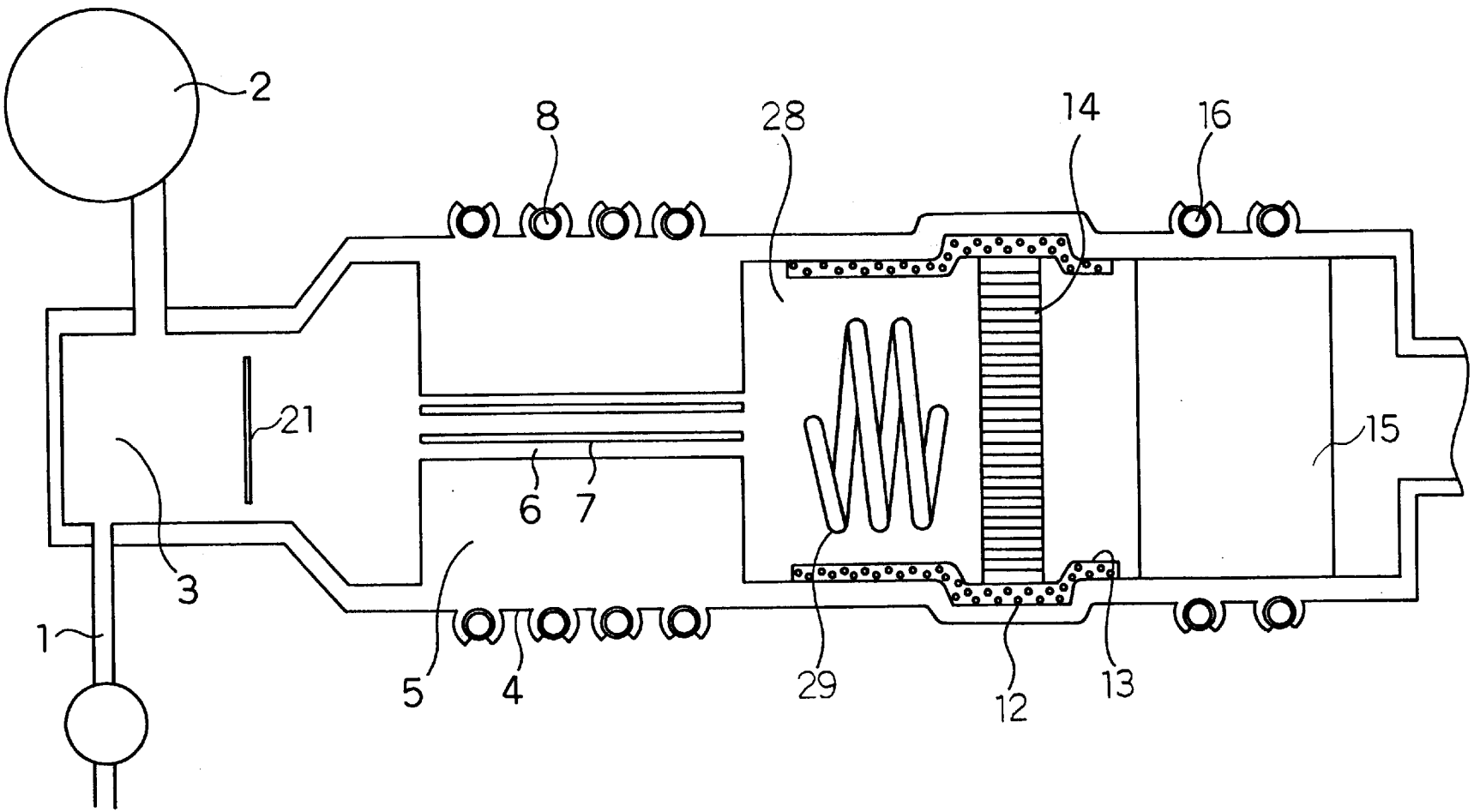
FIG. 5 is a sectional view of a combustion apparatus according to a third embodiment of the invention.

Referring now to FIG. 5, there is shown therein a sectional view of a combustion apparatus according to a third embodiment of the invention. The embodiment is different from the first embodiment in that the flame stabilizing unit 10 is eliminated, and the flame combustion chamber 9 containing the ignition means 11 is replaced with a heater chamber 28 containing an electric heater 29. Other arrangements are similar to those of the first embodiment.

Now, an operation of the embodiment is described.

First, the electric heater 29 is energized, and an upstream side of a second catalyzer 14 and a downstream side of a first catalyzer 7 are heated by heat radiation from the heater and heat convection. In order to heat the first and second catalyzers 7 and 14 to a temperature sufficient for activation of 300° C. or a higher temperature, the electric heater 29 should be preferably at a temperature of 700° C. or a higher temperature.

When the first and second catalyzers 7 and 14 reach such temperature sufficient for activation, the electric heater 29 is de-energized, and supply of a fuel-air mixture from a mixing unit 3 is started.

A reaction of the mixture is initiated in an upstream side of the second catalyzer 14 that is heated. A downstream end of the first catalyzer 7 receiving the heat also starts reacting, and comes to be at a high temperature. The reacting point gradually moves forwards the upstream direction of the first catalyzer 7.

As a volume of the mixture catalytically combusted at the first catalyzer 7 is increased, a concentration of the fuel in the gas that is passed through the heater chamber 28 to the second catalyzer 14 is reduced. With such reduction in concentration of the fuel in the gas flowing to the second catalyzer 14, the fuel supply is increased to achieve stationary combustion. The stationary state of combustion achieved is similar to that of the first embodiment.

The embodiment is characterized in that almost no NOx is produced, because the stationary combustion is achieved without using a flame. An accuracy to the air-fuel ratio at the time of ignition is not required so strictly as in the case of flame ignition.

In the event the fuel-air mixture is flamed due to a high temperature of the electric heater 29 in the heater chamber 28, the flame backfires through a space of the first catalytic combustion chamber 4, and fires the mixing chamber 3 as well. In such manner, if a flame is caused in the mixing chamber 3, as combustion both in the first and second catalytic combustion chambers 4 and 12 is no longer catalytic, the effect of reducing emission of NOx is lost. Therefore, by employing a flame stabilizing unit made of a metal gauze, porous plate or the like similarly to that of FIG. 1, even if a flame is caused due to a high temperature of the heater, such backfire can be prevented.

Figure 6:
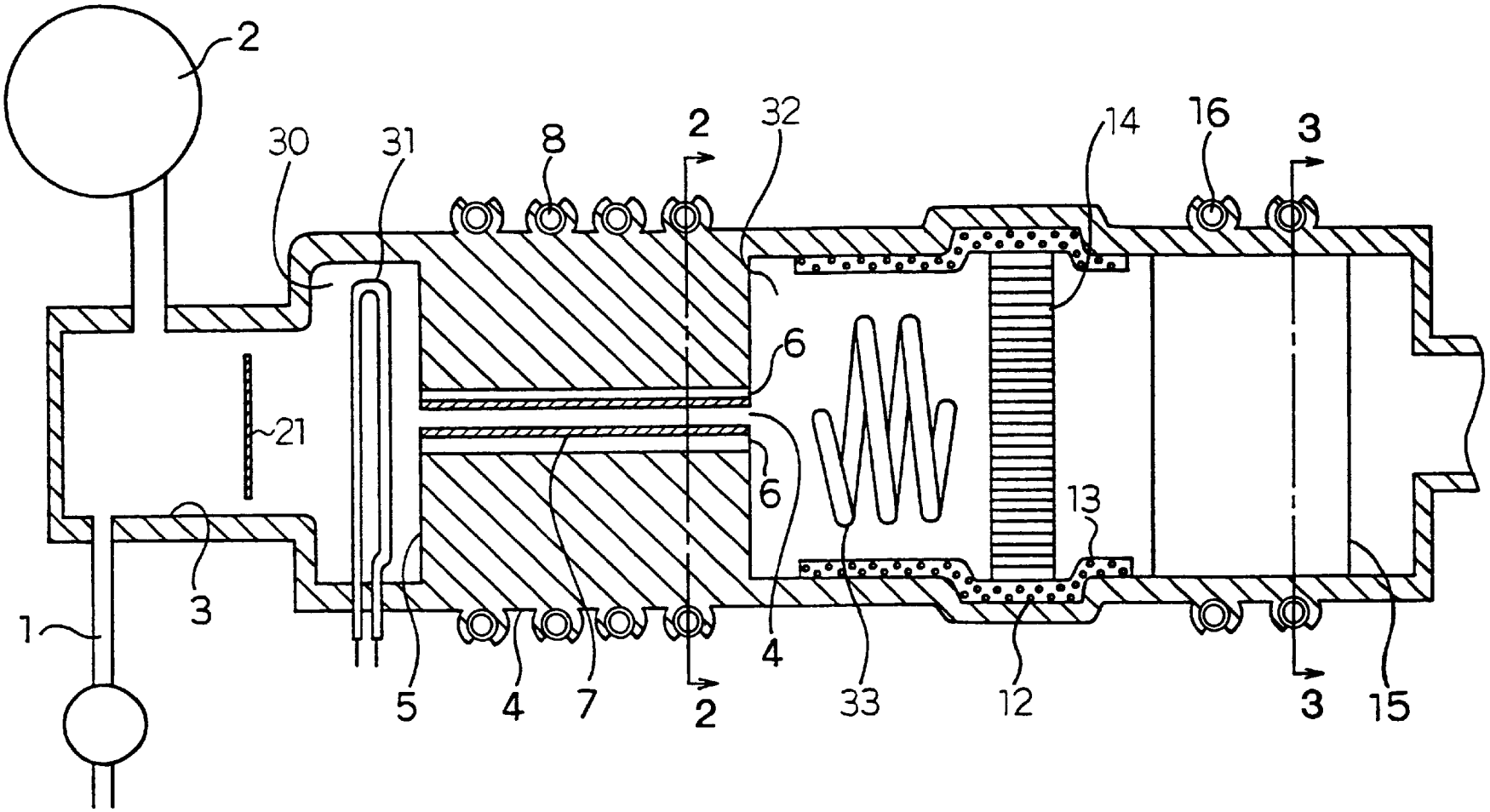
FIG. 6 is a sectional view of a combustion apparatus according to a fourth embodiment of the invention.

Referring now to FIG. 6, there is shown therein a sectional view of a combustion apparatus according to a fourth embodiment of the invention. Reference numeral 30 is a first heater chamber containing a first electric heater 31 that is provided in an upstream side of a first catalytic combustion chamber 4. 32 is a second heater chamber containing a second electric heater 33 that is positioned between the first catalytic combustion chamber 4 and a second catalytic combustion chamber 12. Thus, the embodiment is substantially different from the third embodiment in that it further comprises the first heater chamber 30 containing the first electric heater 31.

Sectional views taken along lines A–A' and B–B' are shown in FIGS. 2 and 3, respectively.

Now, an operation of the embodiment is described.

Preheating of catalysts is initiated by energizing the first and second electric heaters 31 and 33 to simultaneously heat first and second catalyzers 7 and 14. After the first and second catalyzers 7 and 14 reach a specified temperature sufficient for activation, the first and second electric heaters 31 and 33 are de-energized, and supply of a fuel is started. The sequence of de-energization and fuel supply may be reverse.

When a fuel-air mixture fed from a mixing unit 3 is passed through the first catalytic combustion chamber 4, it is partly reacted at the first catalyzer 7 in upstream and downstream sides thereof.

The fuel unreacted and passed through the first catalyzer 7 starts reacting in an upstream side of the second catalyzer 14. Because the second catalyzer 14 is at a high temperature, the unreacted gas is subjected to a reaction there, and almost no unburnt gas is contained in a final exhaust. To prevent emission of an unburnt gas from the combustion chamber to the outside, the second catalyzer 14 should preferably be preheated to a higher temperature than that of the first catalyzer 7.

In the embodiment, since heat generated in the upstream side of first catalyzer 7 is transferred in the downstream direction by a flow of the mixture, a stationary temperature of the first catalyzer 7 can be reached in a short time. Therefore, in the embodiment, a maximum output can be obtained in a less time than that of the third embodiment.

Figure 7:
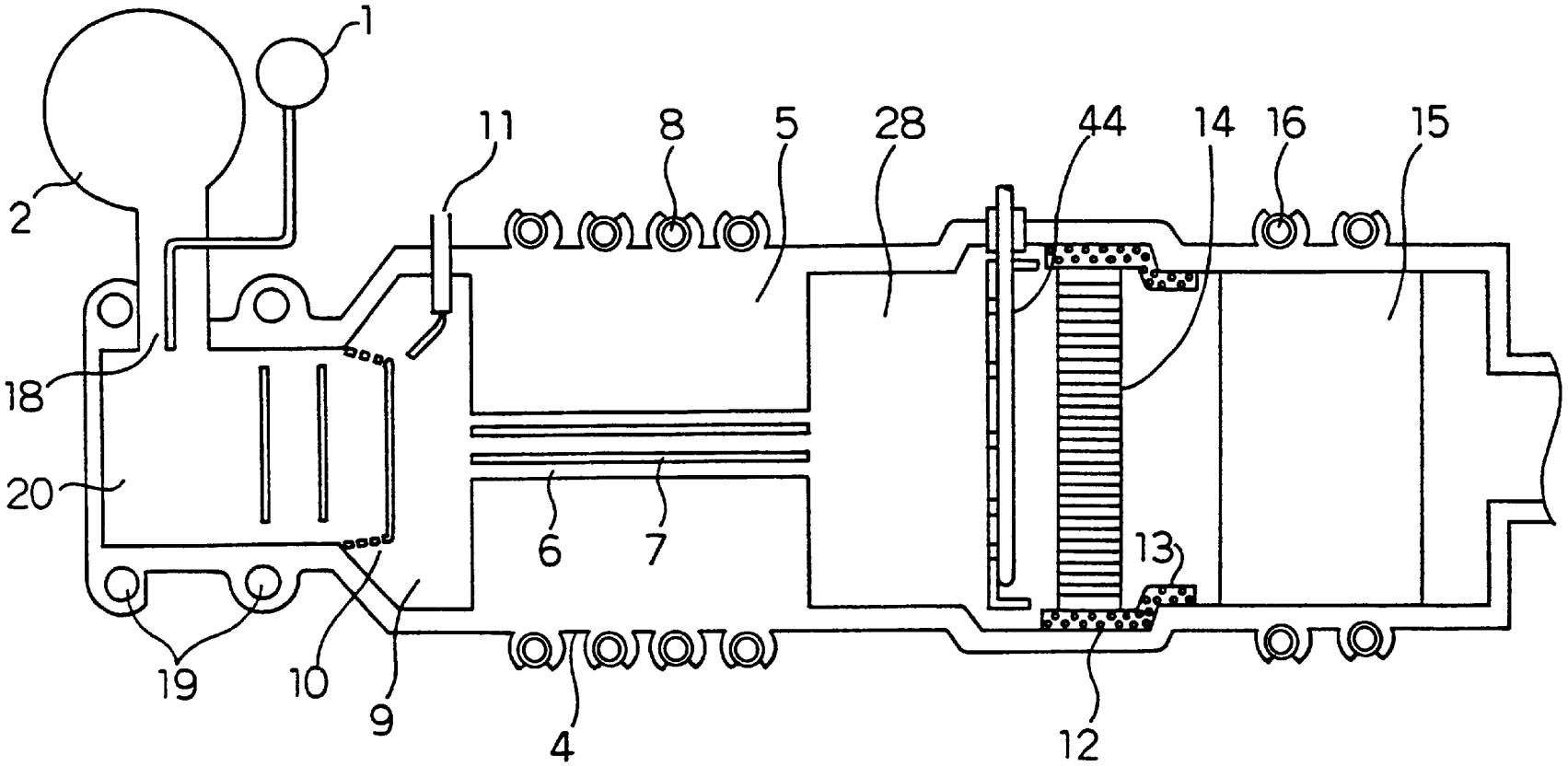
FIG. 7 is a sectional view of a combustion apparatus according to a fifth embodiment of the invention.

Referring now to FIG. 7, there is shown therein a sectional view of a combustion apparatus according to a fifth embodiment of the invention. Reference numeral 1 is a fuel supply unit for feeding a liquid fuel from a leading end of a fuel pipe 18. Reference numeral 19 is a vaporization heater for heating the liquid fuel. Reference numeral 2 shows a fan for supplying combustion air. Reference numeral 20 is a vaporizing unit containing two mixing plates.

Reference numeral 9 shows a flame combustion chamber disposed in a downstream side of the vaporizing unit 20. Reference numeral 11 is ignition means for igniting a fuel-air mixture prepared in the vaporizing unit 20. The ignition means 11 is incorporated in the flame combustion chamber 9. Reference numeral 10 represents a flame stabilizing unit placed between the vaporizing unit 20 and the flame combustion chamber 9.

Reference numeral 4 is a first catalytic combustion chamber provided in a downstream side of the flame combustion chamber 9. Reference numeral 5 shows a heat receiving fin projecting in an inner surface of the first catalytic combustion chamber 4. Reference numeral 7 is a first catalyzer in the shape of a thin plate placed in the fin 5 with a spacing 6 between them. Reference numeral 8 depicts a first water channel provided for collecting heat in an outer circumference of the first catalytic combustion chamber 4 of an aluminum alloy.

Reference numeral 28 represents a heater chamber positioned in a downstream side of the first catalytic combustion chamber 4. Reference numeral 44 is an electric heater incorporated in the heater chamber 28.

Reference numeral 12 is a second catalytic combustion chamber employed in a downstream side of the heater chamber 28. Reference numeral 14 is a second catalyzer of honeycomb construction. The second catalyzer 14 is incorporated in the second catalytic combustion chamber 12.

Reference numeral 15 shows a heat exchanging fin employed for collecting heat in a downstream side of the second catalytic combustion chamber 12. Reference numeral 16 is a second water channel provided for heat exchange in an outer circumferential surface of a chamber incorporating the fin 15. The second water channel 16 is connected with the first water channel 8.

Now, an operation of the embodiment is described.

First, the electric heater 44 is energized to heat the second catalyzer 14, and a fuel-air mixture is fed from the vaporizing unit 20. The mixture supplied to the flame combustion chamber 9 is flamed by the ignition means 11. In such operation, because the second catalyzer 14 is heated by the electric heater 44, odors and CO produced at the time of ignition are purified at the second catalyzer.

When the first catalyzer 7 heated by the flame in the flame combustion chamber 9 reaches a temperature sufficient for activation, supply of the fuel is temporarily discontinued for extinguishing the flame. After the flame is extinguished, as the fuel supply is restarted, catalytic combustion takes place at the first catalyzer 7. Then, because the first catalyzer 7 is incompletely increased in temperature, an unburnt gas is discharged from the heater chamber 28 to the second catalytic combustion chamber 12. The unburnt gas discharged to the second catalytic combustion chamber 12 is subjected to a reaction at the second catalyzer 14 that is heated by the electric heater 44.

Since the first catalyzer 7 is increased in temperature from an upstream side in the flowing direction, when the first catalyzer 7 reaches a temperature of 300 to 600° C. in a downstream side thereof, the fuel supply is increased. By achieving a stationary state of combustion through such timed operation, the second catalyzer 14 can be completely prevented from being heated to an excessively high temperature by the unburnt gas.

In such manner, the combustion is eventually stabilized, 85% of the fuel supplied is burnt at the first catalyzer 7, and the balance at the second catalyzer 14. Such stationary state of combustion is similar to that of the first embodiment. Thus, according to the embodiment, the combustion can be stabilized in a short time, and emission of an unburnt gas at the time of ignition can be reduced.

Figure 8:
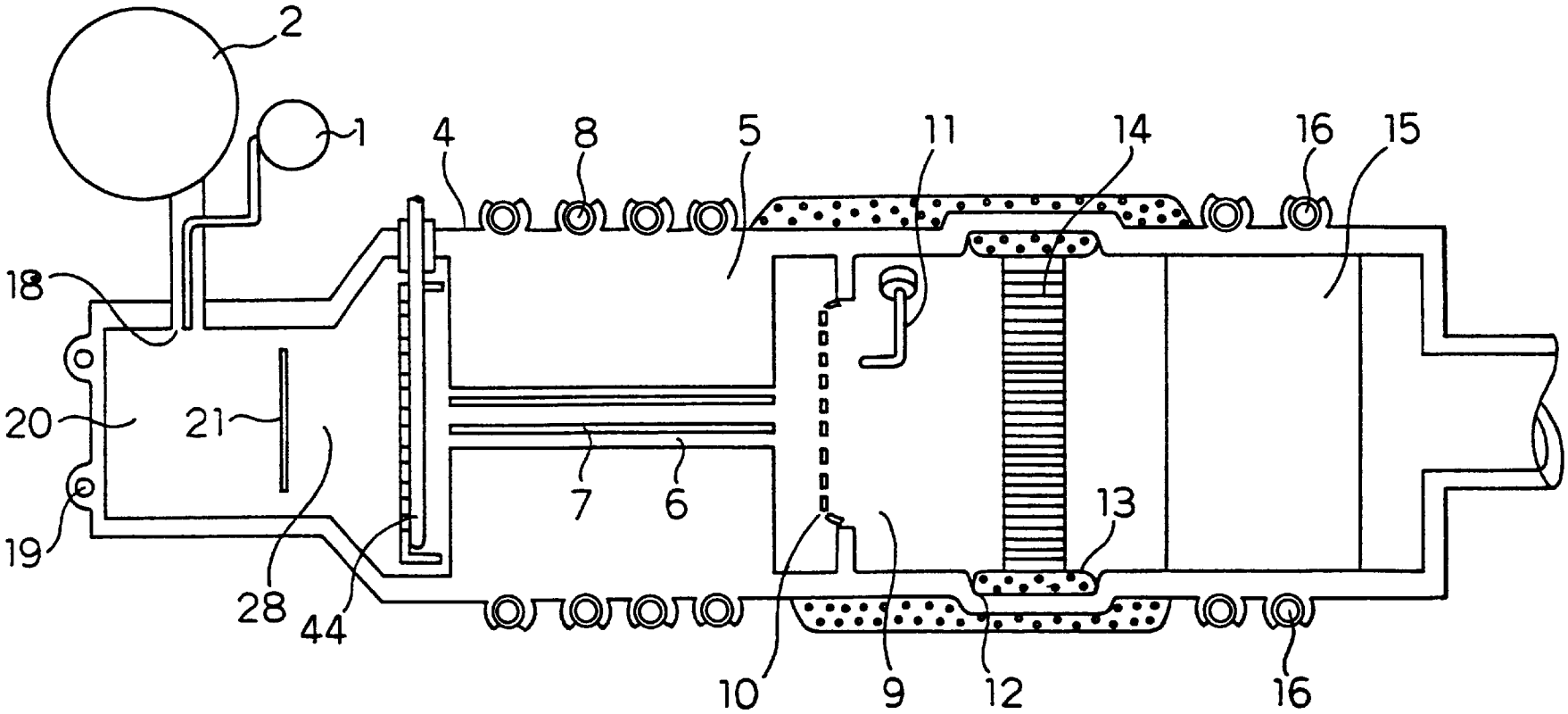
FIG. 8 is a sectional view of a combustion apparatus according to a sixth embodiment of the invention.

Referring to FIG. 8, there is shown therein a sectional view of a combustion apparatus according to a sixth embodiment of the invention. Reference numeral 1 shows a fuel supply unit for feeding a liquid fuel through a fuel pipe 18. Reference numeral 19 is a vaporization heater for heating the liquid fuel. Reference numeral 2 represents a fan for supplying combustion air. Reference numeral 20 is a vaporizing unit for preparing a fuel-air mixture by mixing the liquid fuel, which is supplied by the fuel supply unit 1 and vaporized, with the combustion air supplied by the fan 2.

Reference numeral 28 shows a heater chamber containing an electric heater 44 that is provided downstream of the vaporizing unit 20.

Reference numeral 4 is a first catalytic combustion chamber employed in a downstream side of the heater chamber 28. Reference numeral 5 is a heat receiving fin projecting in an inner surface of the first catalytic combustion chamber 4. Reference numeral 7 depicts a first catalyzer in the shape of a thin plate employed in the fin with a spacing 6 between them. Reference numeral 8 is a first water channel provided for collecting heat in an outer circumference of the first catalytic combustion chamber 4 of an aluminum alloy.

Reference numeral 9 represents a flame combustion chamber positioned in a downstream side of the first catalytic combustion chamber 4. Reference numeral 11 is ignition means for igniting the mixture. The ignition means 11 is incorporated in the flame combustion chamber 9. Reference numeral 10 shows a flame stabilizing unit disposed between the first catalytic combustion chamber 4 and the flame combustion chamber 9.

Reference numeral 12 is a second catalytic combustion chamber placed in a downstream side of the flame combustion chamber 9. Reference numeral 14 shows a second catalyzer of honeycomb construction. The second catalyzer 14 is incorporated in the second catalytic combustion chamber 12.

Reference numeral 15 depicts a heat exchanging fin located in a downstream side of the second catalytic combustion chamber 12 for collecting exhaust heat. Reference numeral 16 is a second water channel provided for heat exchange in an outer circumferential surface of a chamber incorporating the fin 15. The second water channel 16 is connected with the first water channel 8.

Now, an operation of the embodiment is described.

First, the electric heater 44 is energized to heat the first catalyzer 7, and a fuel-air mixture is supplied to the first catalyzer 7. The first catalyzer 7 should be below a temperature sufficient for activation of a catalyst. Because no catalytic reaction is, therefore, caused at the first catalyzer 7, the fuel-air mixture is flamed in the flame combustion chamber 9 by the ignition means 11. The second catalyzer 14 is heated by the flame. The first catalyzer 7 is similarly heated in a downstream side thereof. However, an upstream side of the first catalyzer 7 has already been heated by the electric heater 44, the catalytic combustion reaction rapidly reaches an upstream side of the first catalyzer 7.

In such manner, the combustion is eventually stabilized, and a stationary state similar to that of the first embodiment is achieved. Such system is effective for a liquid fuel, and provides for simplification of a structure.

Figure 9:
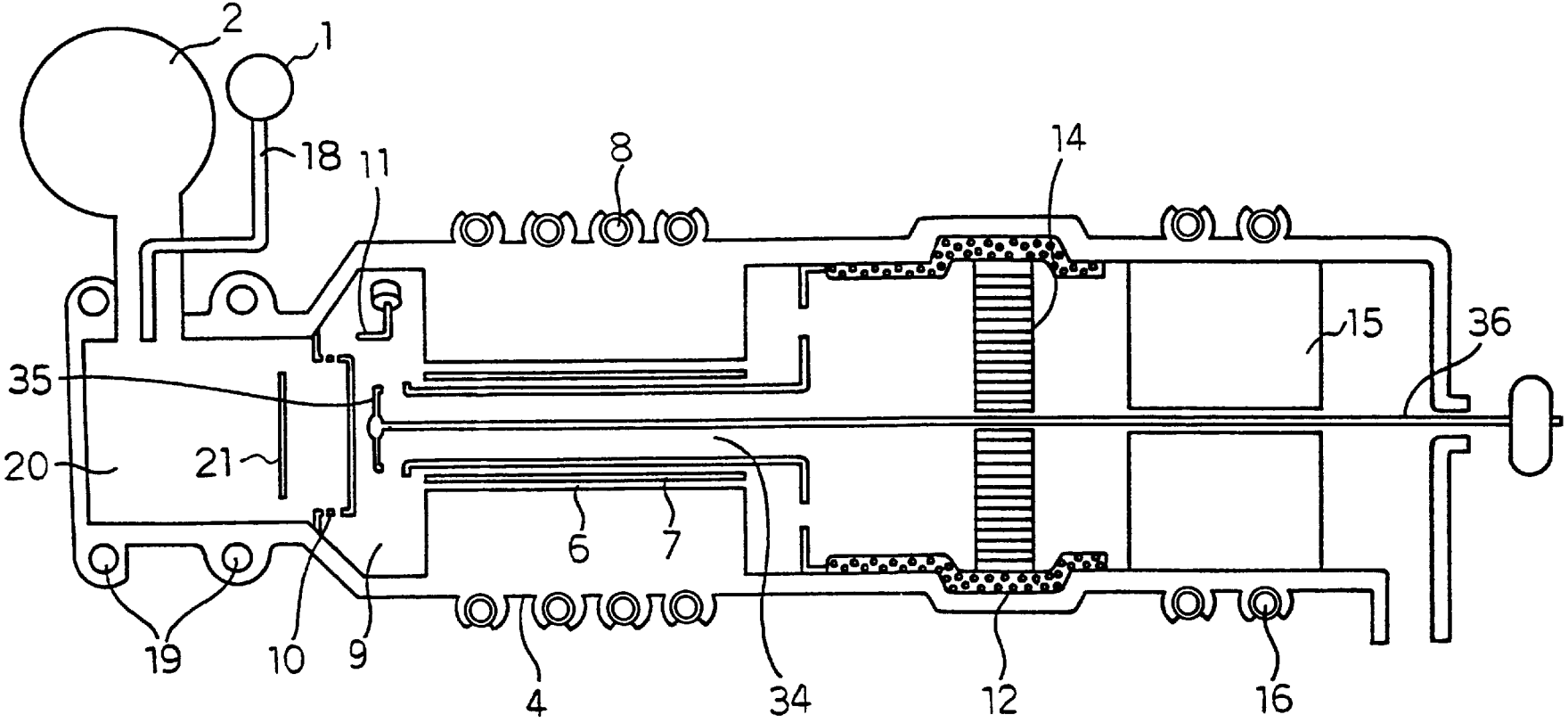
FIG. 9 is a sectional view of a combustion apparatus according to a seventh embodiment of the invention.

Referring now to FIG. 9, there is shown therein a sectional view of a combustion apparatus according to a seventh embodiment of the invention. Reference numeral 1 shows a fuel supply unit for feeding a liquid fuel through a fuel pipe 18. Reference numeral 19 is a vaporization heater for heating the liquid fuel. Reference numeral 2 represents a fan for supplying combustion air. Reference numeral 20 is a vaporizing unit containing a mixing plate 21.

Reference numeral 9 shows a flame combustion chamber positioned in a downstream side of the vaporizing unit 20. Reference numeral 11 is ignition means for igniting a fuel-air mixture that is prepared in the vaporizing unit by utilizing an electric discharge. The ignition means 11 is incorporated in the flame combustion chamber 9. Reference numeral 10 is a flame stabilizing unit disposed between the vaporizing unit 20 and the flame combustion chamber 9.

Reference numeral 4 shows a first catalytic combustion chamber placed in a downstream side of the flame combustion chamber 9. Reference numeral 5 is a heat receiving fin projecting in an inner surface of the first catalytic combustion chamber 4. Reference numeral 7 depicts a first catalyzer in the shape of a thin plate employed in the fin 5 with a spacing 6 between them. Reference numeral 8 is a first water channel provided for collecting heat in an outer circumference of the first catalytic combustion chamber 4 of an aluminum alloy.

Reference numeral 12 is a second catalytic combustion chamber positioned in a downstream side of the first catalytic combustion chamber 4. Reference numeral 14 represents a second catalyzer of honeycomb construction providing a geometric surface area larger than that of the first catalyzer 7. The second catalyzer 14 is incorporated in the second catalytic combustion chamber 12.

Reference numeral 15 is a heat exchanging fin provided for collecting exhaust heat in a downstream side of the second catalytic combustion chamber 12. Reference numeral 16 depicts a second water channel employed for exchanging heat in an outer circumferential surface of a chamber incorporating the fin 15. The second water channel 16 is connected with the first water channel 8.

Reference numeral 34 is a bypass passing through a central part of the first catalytic combustion chamber 4. A closing valve 35 is provided in the bypass, and operated between opening and closing positions by means of a driving member 36. The closing valve 35 is preferably positioned in an upstream side of the bypass 34. It is because the fuel-air mixture retained in the bypass 34 may be flamed due to a high temperature of the first catalyzer, if the closing valve 35 is provided in a downstream side.

Now, an operation of the embodiment is described.

A liquid fuel is transformed to a gaseous fuel in the vaporizing unit 20 that is heated by the vaporization heater 19. The gaseous fuel is mixed with combustion air from the fan 2 by the mixing plate 21 contained in the vaporizing unit 20, and forms a fuel-air mixture. The mixture flows into the flame combustion chamber 9 provided in a downstream side in the flowing direction thereof. The mixture flowing into the flame combustion chamber 9 is ignited by the ignition means 11, and provides a flame.

At this time, an inlet of the bypass 34 positioned in an upstream side in the flowing direction of the mixture is opened by the closing valve 35. Therefore, the first and second catalyzers 7 and 14 are heated by the flame in the flame combustion chamber 9.

When the first and second catalyzers 7 and 14 reach a temperature of 300 to 600° C., supply of the fuel is temporarily discontinued to extinguish the flame in the flame combustion chamber 9. Then, by means of the driving member 36, the closing valve 35 in the inlet of the bypass 34 is operated to the closing position, and supply of the fuel is restarted. In such operation, because the first and second catalyzers 7 and 14 are heated to a temperature sufficient for activation or a higher temperature, the first and second catalyzers 7 and 14 can immediately initiate catalytic combustion, and a stable state is reached.

As described, according to the embodiment, the first and second catalyzers 7 and 14 can be heated to a sufficiently high temperature by using a single ignition means 11.

Figure 10:
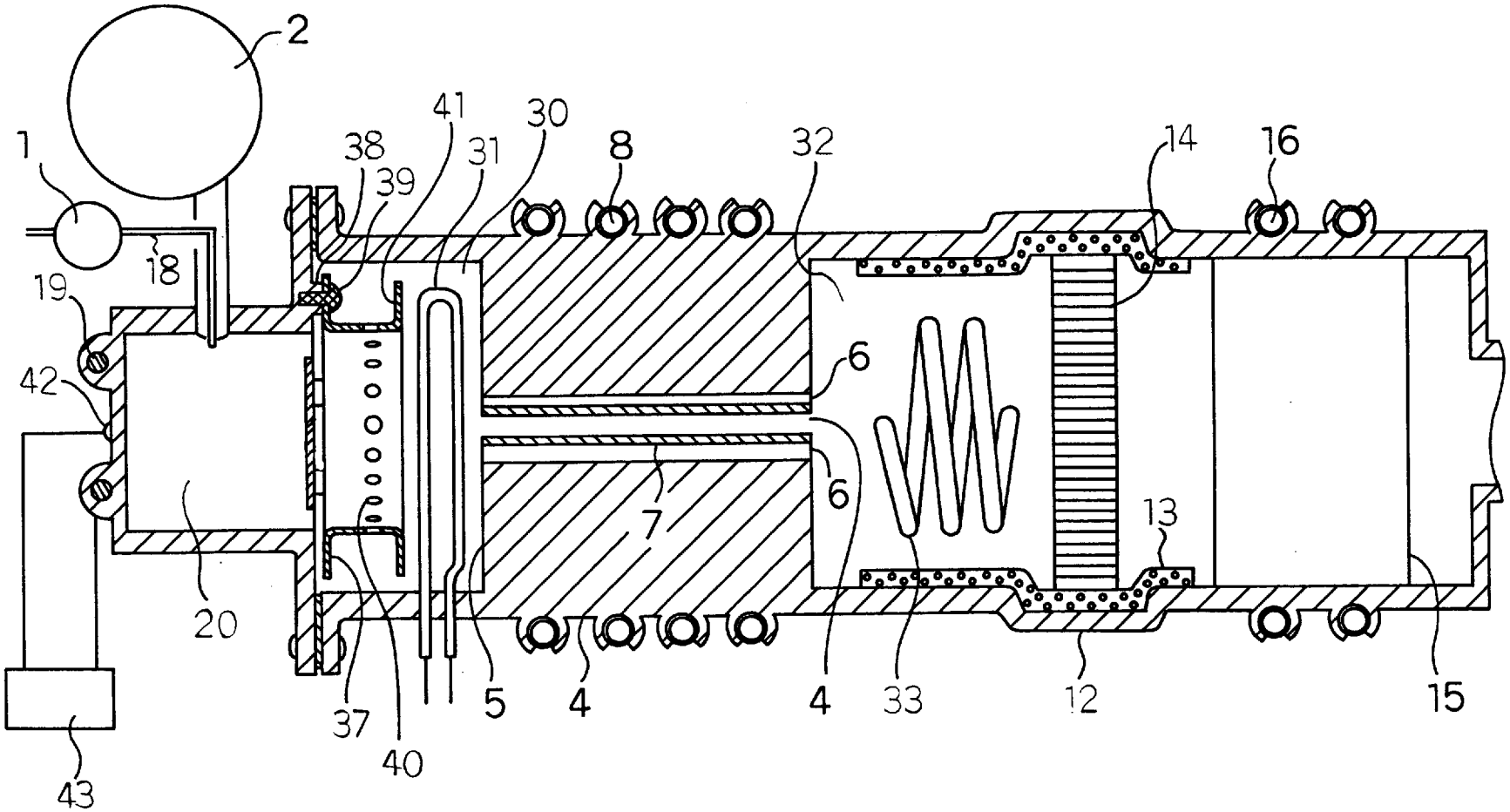
FIG. 10 is a sectional view of a combustion apparatus according to an eighth embodiment of the invention.

Referring now to FIG. 10, there is shown therein a sectional view of a combustion apparatus according to an eighth embodiment of the invention. Reference numeral 1 is a fuel supply unit for feeding a liquid fuel through a fuel pipe 18. Reference numeral 2 is a fan for supplying combustion air. Reference numeral 20 shows a vaporizing unit for preparing a fuel-air mixture by mixing the liquid fuel, that is fed by the fuel supply unit 1 and vaporized, with the combustion air supplied by the fan 2. The vaporizing unit 20 is formed by an aluminum or iron casting. Reference numeral 19 depicts an electric heater for heating the vaporizing unit 20.

Reference numeral 30 represents a first heater chamber containing a first electric heater 31, which is provided in a downstream side of the vaporizing unit 20. A heat collecting plate 37 is attached between the first heater chamber 30 and the vaporizing unit 20. The heat collecting plate 37 is fixed to a projection 38 of the vaporizing unit 20 by means of a screw 39. A side of the heat collecting plate 37 is provided with plural through-holes 40, and a flange 41 is formed in a downstream end thereof. The heat collecting plate 37 is formed by a stainless steel plate, and carries a catalyst.

Reference numeral 4 depicts a first catalytic combustion chamber located in a downstream side of the first heater chamber 30. Reference numeral 5 is a heat receiving fin projecting in an inner surface of the first catalytic combustion chamber 4. Reference numeral 7 shows a first catalyzer in the shape of a thin plate formed in the fin with a spacing 6 between them. Reference numeral 8 is a first water channel provided for collecting heat in an outer circumference of the first catalytic combustion chamber 4 of an aluminum alloy. A surface area of the heat collecting plate 37 is smaller than that of a catalyst of the first catalyzer 7.

Reference numeral 32 is a second heater chamber located in a downstream side of the first catalytic combustion chamber 4. Reference numeral 33 represents an electric heater incorporated in the second heater chamber 32.

Reference numeral 12 is a second catalytic combustion chamber located in a downstream side of the second heater chamber 32. Reference numeral 14 shows a second catalyzer of honeycomb construction. The second catalyzer 14 is incorporated in the second catalytic combustion chamber 12.

Reference numeral 15 represents a heat exchanging fin provided in a downstream side of the second catalytic combustion chamber 12 for collecting exhaust heat. Reference numeral 16 depicts a second water channel employed in an outer circumferential surface of a chamber incorporating the fin 15 for heat exchange. The second water channel 16 is connected with the first water channel 8.

Reference numeral 42 is a sensing unit positioned in an outer surface of the vaporizing unit 20 for detecting a temperature inside the vaporizing unit 20. Reference numeral 43 shows input power control means for controlling the vaporizing heater in such manner that the vaporizing unit 20 is maintained at a temperature higher than a boiling point of the liquid fuel according to a result of detection by the sensing unit.

An operation of the embodiment is described below.

The vaporization heater 19 and the first electric heater 31 are energized, and the vaporizing unit 20, heat collecting plate 37 and first catalyzer 7 are heated. Such liquid fuel as kerosene or light oil is supplied to the vaporizing unit 20 where it is transformed to be a gaseous fuel, mixed with combustion air sent from the fan, and forms a fuel-air mixture.

The mixture is passed through the heat collecting plate 37, and starts burning catalytically at the first catalyzer 7. At the same time, reaction of a catalyst in the heat collecting plate 37 heated by the first electric heater 31 is started. Heat resulting from the reaction is transferred from the projection 38 to the vaporizing unit 20, and the vaporizing unit 20 is thereby heated. In the flange 41 of the heat collecting plate 37, heating is enhanced by heat radiated from the first catalyzer 7. As the catalytic reaction is further proceeded, the heat collecting plate 37 is heated to a temperature of 400 to 600° C. The heat is transferred from the heat collecting plate 37 to the vaporizing unit 20.

Incidentally, a metallic material forming the heat collecting plate 37 preferably has a thermal conductivity lower than a metallic material forming the vaporizing unit 20. If the heat conductivity is high, because the heat is excessively removed from the heat collecting plate to the vaporizing unit 20, resulting in a low temperature of the former, and a reactivity of catalyst in the heat collecting plate 37 is reduced. Accordingly, it is advantageous to provide the projection 38 in a connection between the vaporizing unit 20 and heat collecting plate 37 for selecting a contact area so that conduction of vaporization heat is optimized.

In order to intensify reaction of the catalyst in the heat collecting plate 37, it is advantageous to provide through-holes 40 in the heat collecting plate 37. In such case, the fuel-air mixture is reacted in front and back sides of the heat collecting plate 37, resulting in intensified reaction as well as increase of a heat resistance of the heat collecting plate 37, a leading end thereof is heated to a higher temperature, and a higher reactivity is obtained.

In such catalytic combustion, when it is detected by the sensing unit 42 that the vaporizing unit 20 has reached a specified temperature in the inside, the input power control means 43 de-energizes the vaporizing heater 19. Thereafter, the input power control means 43 repeatedly switches the vaporization heater 19 on and off so that the vaporizing unit 20 is maintained at a temperature higher than the boiling point. In such manner, consumption of an electric power for vaporization of the liquid fuel in catalytic combustion can be reduced.

Although the first catalyzer 7 in the embodiment is integrated with a heat exchanger similarly to the first catalyzer 7 of the first embodiment, it may be a catalyzer of honeycomb construction.

Figure 11A:
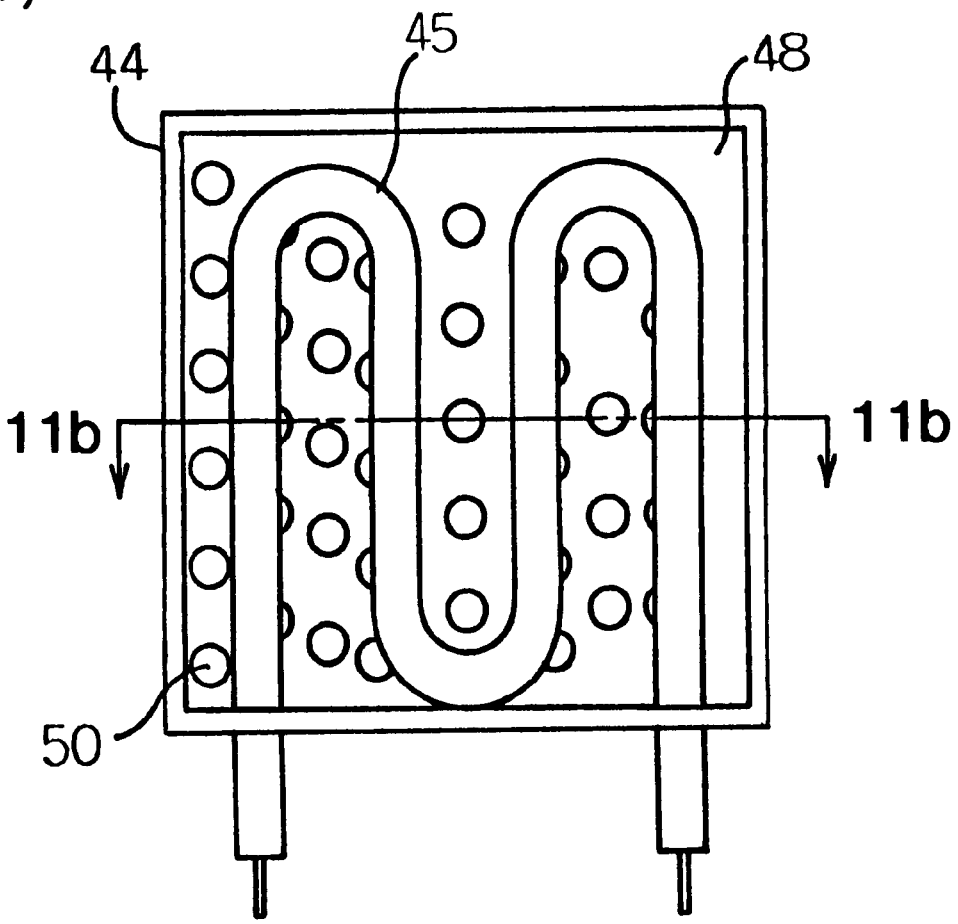
FIG. 11(*a*) is a structural drawing of an electric heater 44 employed in the fifth and sixth embodiments.
Figure 11B:
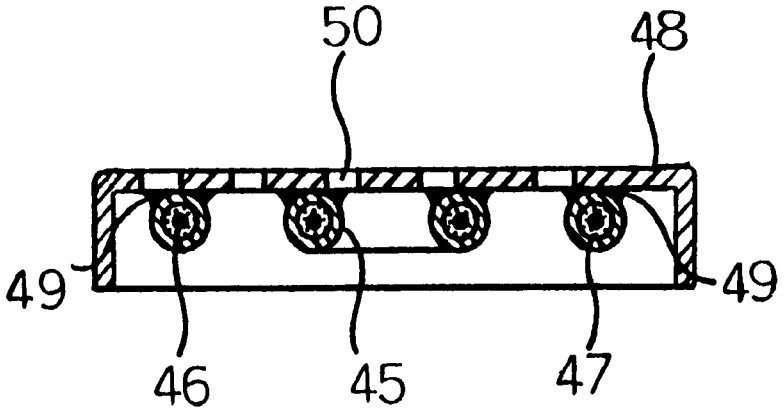

The electric heater 44 employed in the fifth and sixth embodiments is described by referring to FIG. 11, which shows a structure thereof. FIG. 11(*b*) is a sectional view taken along a line Z–Z' of FIG. 11(*a*). The electric heater 44 may be also applied to other embodiments in which an electric heater different from that of the fifth and sixth embodiments is used. Reference numeral 45 shows a coated metal tube. Reference numeral 46 is a heating wire contained in the coated metal tube 45. The heating wire 46 is insulated from the coated metal tube by a magnesia insulator 44.

Reference numeral 48 represents a cooling plate with a heat radiating member formed in a surface thereof. The cooling plate 48 is provided with multiple through-holes. Now, if the electric heater 44 is positioned in opposition to a catalyzer in a flow passage of fuel-air mixture, the temperature around the catalyzer tends to be low. Therefore, by forming the cooling plate 48 in the shape of a box that has bottom and side surfaces, and increasing an area of contact with the atmosphere, heating can be evenly achieved.

The coated metal tube 46 is joined with the cooling plate 48 by means of a nickel solder 49.

By positioning the electric heater 44 such that it faces the first or second catalyzer 7 or 14, the catalyst can be preheated.

Generally, in order to achieve rapid preheating, a higher electric power is required for the electric heater. However, it leads to a temperature rise of the coated metal tube in the electric heater, and it is a problem that the coated metal tube is reduced in quality.

In the electric heater 44 according to the embodiment, because the coated metal tube 45 is connected to the cooling plate 48 which is surface-treated for facilitating heat radiation, heat distributed in the cooling plate 48 is dispersed as a radiated heat. Consequently, the reduction in quality of the coated metal tube 45 is controlled. Therefore, rapid preheating can be achieved, and time required for preheating of the catalyst is reduced.

Although the through-holes 50 are provided for passing the fuel-air mixture therethrough, a heating capacity can be further increased by aligning the holes in the vicinity of the coating metal tube 45.

Although the cooling plate 48 is formed in the shape of a box having bottom and side surfaces, it may be in the shape of a flat plate.

What is claimed is:

1. A combustion apparatus comprising:

a fuel-air mixture preparing unit;

a first catalytic combustion chamber containing a first catalyzer to catalytically burn said mixture and a first heat collecting unit for collecting a thermal energy generated during the catalytic combustion of the mixture by the first catalyzer, said first catalytic combustion chamber being located in a downstream side with respect to a flowing direction of said mixture, said first catalyzer is fixed such that said first catalyzer is substantially positioned along said first heat collecting unit;

a second catalytic combustion chamber containing a second catalyzer to catalytically burn the mixture that is not catalytically burned by said first catalyzer, said second catalytic combustion chamber being located in a discharge side of said first catalytic combustion chamber, said second catalyzer having a surface area larger than that of said first catalyzer; and means for heating and igniting said mixture, said heating and igniting means disposed between said first catalyzer and said second catalyzer.

2. The combustion apparatus of claim 1 wherein:

said first heat collecting unit is a fin, and said first catalyzer is attached to said fin such that it is positioned along said fin with a predetermined spacing between said first catalyzer and said fin.

3. The combustion apparatus of claim 2 wherein:

said fin has a plurality of surfaces for collecting said thermal energy, and said predetermined space is narrower than the space between each of the opposing surfaces of said fin.

4. The combustion apparatus of claim 1 wherein:

said first catalyzer has a first base member of metal, said first base member coated with a first catalyst layer; and said second catalyzer has a second base member made of ceramic, said second base member coated with a second catalyst layer.

5. The combustion apparatus of claim 1 wherein combustion power of said first catalytic combustion chamber is larger than the combusion power of said second catalytic combustion chamber.

6. The combustion apparatus of claim 1 further comprising a first heat removing unit attached to an outer surface of said first catalytic combustion chamber for removing the thermal energy that is collected by said first heat collecting unit.

7. The combustion apparatus of claim 6 wherein said first heat removing unit removes said thermal energy using a medium comprising one of water or air.

8. The combustion apparatus of claim 1 further comprising:

a second heat collecting unit for collecting thermal energy contained in an exhaust that is emitted from said second catalytic combustion chamber, said second heat collecting unit being located in a discharge side of said second catalytic combustion chamber; and a second heat removing unit for removing the thermal energy collected by said second heat collecting unit to an outside, said second heat removing unit being attached to an outer surface of a chamber in which said second heat collecting unit is contained.

9. The combustion apparatus of claim 8 wherein:

said second heat collecting unit is a fin, and said second heat removing unit removes the thermal energy using a medium comprising one of water or air.

10. The combustion apparatus of claim 1 further comprising a first flame combustion chamber incorporating said heating and igniting means, said first flame combustion chamber located between said fuel-air mixture preparing unit and said first catalytic combustion chamber.

11. The combustion apparatus of claim 10 further comprising a first flame stabilizer for preventing a flame that is produced in said first flame combustion chamber from being developed in said fuel-air mixture preparing unit, said first flame stabilizer being located between said fuel-air mixture preparing unit and said first flame combustion chamber.

12. The combustion apparatus of claim 1 further comprising a second flame combustion chamber incorporating a second heating and igniting means, said second flame combustion chamber located between said first and second catalytic combustion chambers.

13. The combustion apparatus of claim 12 further comprising a second flame stabilizing unit for preventing a flame that is produced in said second flame combustion chamber from being developed in a direction of said first catalytic combustion chamber, said second flame stabilizing unit being located between said first catalytic combustion chamber and said second flame combustion chamber.

14. A combustion apparatus comprising:

a fuel-air mixture preparing unit;

a first catalytic combustion chamber containing a first catalyzer to catalytically burn said mixture and a first heat collecting unit for collecting a thermal energy generated during the catalytic combustion of the mixture by the first catalyzer, said first catalytic combustion chamber being located in a downstream side with respect to a flowing direction of said mixture, said first catalyzer is fixed such that said first catalyzer is substantially positioned along said first heat collecting unit;

a second catalytic combustion chamber containing a second catalyzer to catalytically burn the mixture that is not catalytically burned by said first catalyzer, said second catalytic combustion chamber being located in a discharge side of said first catalytic combustion chamber, said second catalyzer having a surface area larger than that of said first catalyzer; and a first heating chamber containing a first heating means, said first heating chamber being located between said fuel-air mixture preparing unit and said first catalytic combustion chamber.

15. The combustion apparatus of claim 14 further comprising a first flame stabilizer for preventing a flame that is produced in said first heating chamber from being developed in said fuel-air mixture preparing unit, said first flame stabilizer being located between said fuel-air mixture preparing unit and said first heating chamber.

16. The combustion apparatus of claim 14 wherein:

said first heating means comprises:

a heating wire;

a coated metal tube containing said heating wire;

an insulating member placed in said coated metal tube for insulating said heating wire from said coated metal tube; and a cooling plate with a plurality of holes and a heat radiating member formed in a surface thereof;

wherein said coated metal tube is joined to said cooling plate.

17. The combustion apparatus of claim 16 wherein said cooling plate is cubic and has a bottom, and said coated metal tube is joined with the plate on the bottom surface thereof.

18. A combustion apparatus comprising:

a fuel-air mixture preparing unit;

a first catalytic combustion chamber containing a first catalyzer to catalytically bum said mixture and a first heat collecting unit for collecting a thermal energy generated during the catalytic combustion of the mixture by the first catalyzer, said first catalytic combustion chamber being located in a downstream side with respect to a flowing direction of said mixture, said first catalyzer is fixed such that said first catalyzer is substantially positioned along said first heat collecting unit;

a second catalytic combustion chamber containing a second catalyzer to catalytically burn the mixture that is not catalytically burned by said first catalyzer, said second catalytic combustion chamber being located in a discharge side of said first catalytic combustion chamber, said second catalyzer having a surface area larger than that of said first catalyzer; and a second heating chamber containing a second heating means, said second heating chamber being located between said first catalytic combustion chamber and said second catalytic combustion chamber.

19. The combustion apparatus of claim 18 further comprising a second flame stabilizing unit for preventing a flame that is produced in said second heating chamber from being developed in a direction of said first catalytic combustion chamber, said second flame stabilizing unit being located between said first calalytice combustion chamber and said second heating chamber.

20. A combustion apparatus comprising:

a fuel-air mixture preparing unit for mixing fuel and air to prepare a fuel-air mixture, wherein said fuel-air mixture preparing unit is comprised of a metallic material having a first thermal conductivity;

a vaporizing unit;

a heat collecting plate located in a down stream side of said vaporizing unit, said heat collecting plate coated with a catalyst layer, part of said heat collecting plate being connected to said vaporizing unit;

a catalytic combustion chamber containing a catalyzer, said catalytic combustion chamber being located in a down stream side of said heat collecting plate;

a first flame combustion chamber having a first means for ignition, said first flame combustion chamber located between said fuel-air mixture preparing unit and said first catalytic combustion chamber;

a heat collecting unit for returning heat to said fuel-air mixture preparing unit, said heat collecting unit located between said fuel-air mixture preparing unit and said first flame combustion chamber, said heat being generated in said first flame combustion chamber, wherein said heat collecting unit is comprised of a metallic material having a second thermal conductivity which is less than said first thermal conductivity of said fuel-air mixture preparing unit;

a sensing unit for detecting the temperature inside said vaporizing unit; and a power control means for controlling the power of said vaporizing heater.

21. A combustion apparatus comprising:

a fuel-air mixture preparing unit;

a first catalytic combustion chamber containing a first catalyzer to catalytically burn said mixture and a first heat collecting unit for collecting a thermal energy generated during the catalytic combustion of the mixture by the first catalyzer, said first catalytic combustion chamber being located in a downstream side with respect to a flowing direction of said mixture, said first catalyzer is fixed such that said first catalyzer is substantially positioned along said first heat collecting unit;

a second catalytic combustion chamber containing a second catalyzer to catalytically burn the mixture that is not catalytically burned by said first catalyzer, said second catalytic combustion chamber being located in a discharge side of said first catalytic combustion chamber, said second catalyzer having a surface area larger than that of said first catalyzer; and said second catalyzer having an upstream side and a downstream side; and means for heating and igniting said mixture, said heating and igniting means disposed between said first catalyzer and said second catalyzer to provide heat at said up stream side of said second catalyzer and cause the second catalyzer to catalytically burn the mixture gas before the first catalyzer catalytically burns the mixture gas;

wherein the point of burning moves over time from the second catalyzer to the first catalyzer against the flow direction of the mixture gas such that the mixture gas flow velocity is lower than the flash back velocity.

22. The combustion apparatus of claim 21 wherein:

said first heat collecting unit is a fin, and said first catalyzer is attached to said fin such that it is positioned along said fin with a predetermined spacing between said first catalyzer and said fin.

23. The combustion apparatus of claim 21 wherein:

said fin has a plurality of surfaces for collecting said thermal energy, and said predetermined space is narrower than the space between each of the opposing surfaces of said fin.

24. The combustion apparatus of claim 21 wherein:

said first catalyzer has a first base member of metal, said first base member coated with a first catalyst layer; and said second catalyzer has a second base member made of ceramic, said second base member coated with a second catalyst layer.

* * * * *

UNITED STATES PATENT AND TRADE MARK OFFICE

CERTIFICATE OF CORRECTION

PATENT NO. : 5,938,427
DATED : August 17, 1999
INVENTOR(S) : Suzuki et al.

It is certified that error appears in the above-identified patent and that said Letters Patent is hereby corrected as shown below:

In field [56] on the cover page of the Letters Patent, delete "Lloyd" and insert --Lloyd--.

In column 19, claim 19, line 17 of the Letters Patent, delete "calaytice" and insert --calaytic--.

Signed and Sealed this

Twenty-sixth Day of December, 2000

*Attest:*

Q. TODD DICKINSON

*Attesting Officer*

*Director of Patents and Trademarks*